US005954228A

United States Patent [19]

Minnette

[11] Patent Number: 5,954,228

[45] Date of Patent: Sep. 21, 1999

[54] SAFETY DISPENSER

[75] Inventor: Jeffrey C. Minnette, Evansville, Ind.

[73] Assignee: Rexam Plastics Inc., Evansville, Ind.

[21] Appl. No.: 09/023,495

[22] Filed: Feb. 13, 1998

[51] Int. Cl.[6] ..... B65G 59/00

[52] U.S. Cl. ..... 221/151; 221/152

[58] Field of Search ..... 221/152, 196, 221/263, 264, 276

[56] References Cited

U.S. PATENT DOCUMENTS

| | | | |
|---|---|---|---|
| 4,492,316 | 1/1985 | Emms | 221/264 X |
| 5,018,644 | 5/1991 | Hackmann et al. | 221/152 X |
| 5,657,901 | 8/1997 | Farside . | |
| 5,816,441 | 10/1998 | Farside | 221/152 |

FOREIGN PATENT DOCUMENTS

| | | |
|---|---|---|
| 2107678 | 5/1983 | United Kingdom . |

*Primary Examiner*—William E. Terrell
*Assistant Examiner*—Gene O. Crawford
*Attorney, Agent, or Firm*—Middleton & Reutlinger; John F. Salazar; Charles G. Lamb

[57] ABSTRACT

A safety dispenser providing a container portion having a peripheral side wall defining a cavity therein, an open upper end, a bottom wall and a channel wall disposed between the upper end and the bottom wall, the channel wall extending across the cavity and defining a hopper area and a channel thereby; a trigger being slidingly received by the channel, the trigger having a passageway therethrough and at least one spring member projecting upwardly therefrom; the trigger being moveable within the channel between a first position and a second position, the passageway being in communication with a hole in the channel wall when the trigger is in the first position, the passageway being in communication with an orifice in the bottom wall when the trigger is in the second position; the at least one spring member being engageable with at least one abutment provided on a vertical wall projecting upwardly from the channel wall, the at least one spring member being disengagable from the at least one abutment upon applying a force to the peripheral side wall; and, the at least one spring member biasing the trigger in the first position.

8 Claims, 10 Drawing Sheets

SAFETY DISPENSER

CROSS-REFERENCE TO RELATED APPLICATIONS

This application claims priority from my U.S. Provisional Patent Application Ser. No. 60/038,365 entitled "Child-Resistant Package with One-at-a-Time Dispenser" filed on Feb. 13, 1997.

BACKGROUND OF THE INVENTION

1. Technical Field of the Invention

The present invention relates to a dispenser for use with a supply of pills, tablets, capsules or the like. More particularly, the present invention relates to a dispenser for use with a supply of pills, tablets or capsules, wherein the dispenser includes safety features and wherein the supply of pills, tablets or capsules is dispensable therefrom one-at-a-time only upon successful manipulation of the safety features.

2. Description of the Related Art

Oftentimes, an individual diagnosed with an illness is required to take periodic doses of a medication according to a fixed time schedule, such as, for example, by ingesting a medicated pill, tablet, capsule or the like, every four hours. It is quite common for such an individual to be prescribed a supply of the pills, tablets or capsules, of a quantity thereof sufficient for numerous doses throughout a period of several days, weeks or months. The supply of pills, tablets or capsules, is typically issued to the individual in a disposable bottle which the individual carries on his/her person so that the supply of pills, tablets or capsules is at-hand when it becomes necessary to take a dose thereof.

It has been observed that the bottle typical of those of the prior art is oftentimes cumbersome, or otherwise provides an inefficient means of dispensing the pills, tablets or capsules therefrom. It is therefor desirable to provide a device for storing and dispensing therefrom a supply of pills, tablets or capsules, wherein the device is easy to carry, and wherein the device provides a means by which the pills, tablets or capsules stored therein can be individually dispensed therefrom, such as, by a single pill, tablet or capsule at a time, while retaining the remaining pills, tablets, capsules therein for future dispensing therefrom.

It is even further desirable to provide a device for storing and dispensing therefrom a supply of pills, tablets or capsules, wherein the device provides means for preventing the dispensing therefrom by a child of tender years.

For example, U.S. Pat. No. 5,657,901 to Farside teaches a tablet dispenser with a child-resistant locking feature. However, it is even further desirable to provide a device for storing and dispensing therefrom a supply of pills, tablets or capsules, wherein the device provides means for preventing the dispensing therefrom by a child of tender years and wherein the means for preventing the dispensing therefrom by a child of tender years requires the user to apply a force thereto in a direction other than in a direction of a force applied by the user thereto to dispense the pill, tablet or capsule therefrom.

SUMMARY OF THE INVENTION

The present invention is for a safety dispenser for receiving, storing and dispensing therefrom one-at-a-time a plurality of pills, tablets, capsules or the like.

It is an object of the present invention to provide a device for storing and dispensing therefrom a supply of pills, tablets or capsules, wherein the device is easy to carry, and wherein the device provides a means by which the pills, tablets or capsules stored therein can be individually dispensed therefrom a single pill, tablet or capsule at a time, while retaining the remaining pills, tablets or capsules therein for future dispensing therefrom.

It is another object of the present invention to provide a device for storing and dispensing therefrom a supply of pills, tablets or capsules, wherein the device provides means for preventing the dispensing therefrom by a child of tender years.

It is yet another object of the present invention to provide a device for storing and dispensing therefrom a supply of pills, tablets or capsules, wherein the device provides means for preventing the dispensing therefrom by a child of tender years and wherein the means for preventing the dispensing therefrom by a child of tender years requires the user to apply a force thereto in a direction other than in a direction of a force applied by the user thereto to dispense the pill, tablet or capsule therefrom.

A pill dispenser according to a preferred embodiment of the present invention includes a container portion having a peripheral side wall defining a cavity therein, an open upper end, a bottom wall and a channel wall disposed between the upper end and the bottom wall, the channel wall extending across the cavity and defining a hopper area and a channel thereby; a trigger being slidingly received by the channel, the trigger having a passageway therethrough and at least one spring member projecting upwardly therefrom; the trigger being moveable within the channel between a first position and a second position, the passageway being in communication with a hole in the channel wall when the trigger is in the first position, the passageway being in communication with an orifice in the bottom wall when the trigger is in the second position; the at least one spring member being engageable with at least one abutment provided on a vertical wall projecting upwardly from the channel wall, the at least one spring member being disengagable from the at least one abutment upon applying a force to the peripheral side wall; and, the at least one spring member biasing the trigger in the first position.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENTS

Figure 1:
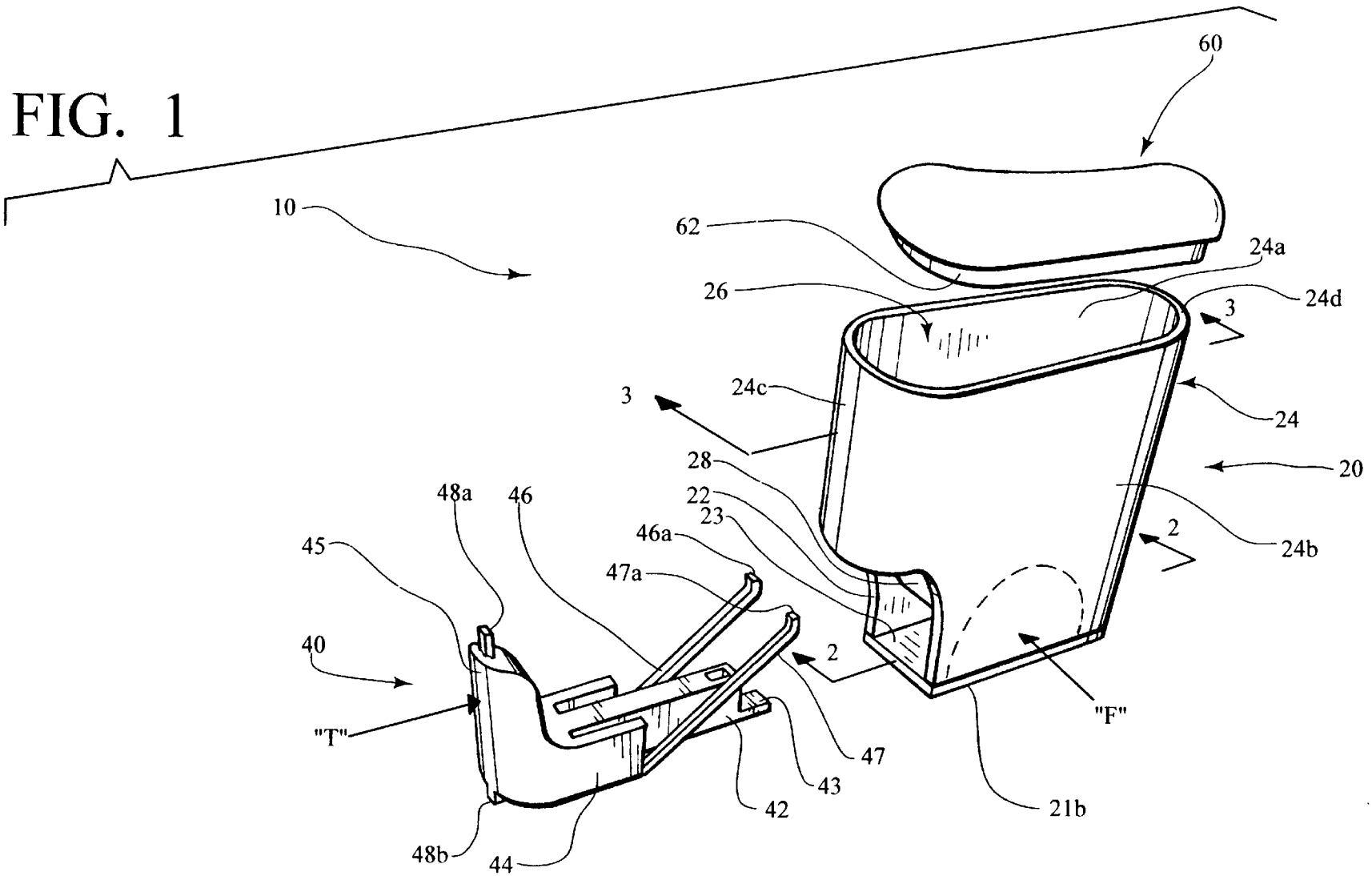
FIG. 1 is an exploded perspective view of an unassembled safety dispenser according to a preferred embodiment of the present invention.

With reference to FIG. 1, a safety dispenser 10 according to a preferred embodiment of the present invention includes a container portion 20, a trigger 40 slidingly received by an opening 22 in the container portion 20 and a lid 60 snap-fit onto an open upper end 21*a* of the container portion 20. The container portion 20, the trigger 40 and the lid 60 are each constructed preferably from an integrally-molded plastic, such as, for example, polyethylene or polypropylene, although any suitable material may be substituted in place thereof without departing from either the spirit or the scope of the present invention.

Figure 2:
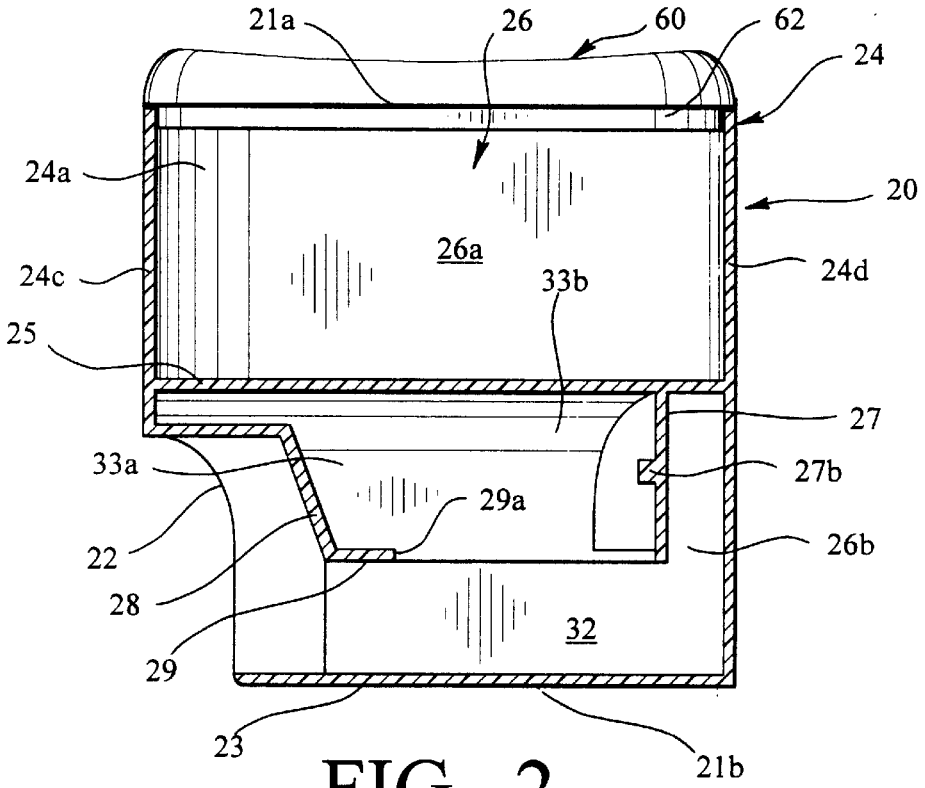
FIG. 2 is a section view of one component of the safety dispenser of FIG. 1 shown along section line 2—2 of FIG. 1.

With additional reference to FIG. 2, the container portion 20 includes a peripheral side wall 24 having first and second opposed lateral portions 24*a*, 24*b* and first and second opposed transverse end portions 24*c*, 24*d*, wherein the side wall 24 defines a cavity 26 for receiving and storing therein a plurality of pills, tablets, capsules or the like, through the open upper end 21*a*. A dividing wall 25 is integrally molded with the side wall 24 and extends across the cavity 26 coextensively between the side wall lateral portions 24*a*, 24*b* and between the side wall transverse end portions 24*c*, 24*d*. The dividing wall 25 defines a cavity upper portion 26*a* between the dividing wall 25 and the open upper end 21*a* of the container portion 20, and a cavity lower portion 26*b* between the dividing wall 25 and a bottom wall 23 provided at a lower end 21*b* of the container portion 20.

Figure 3:
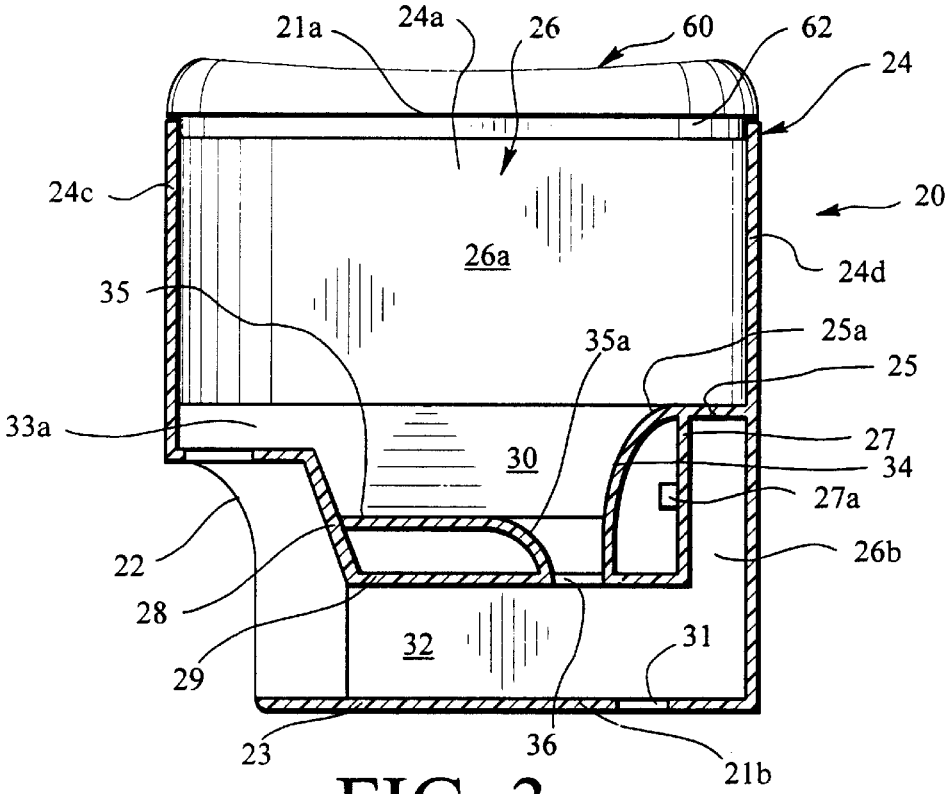
FIG. 3 is a section view of the component of the safety dispenser of FIG. 2 shown along section line 3—3 of FIG. 1.
Figure 6:
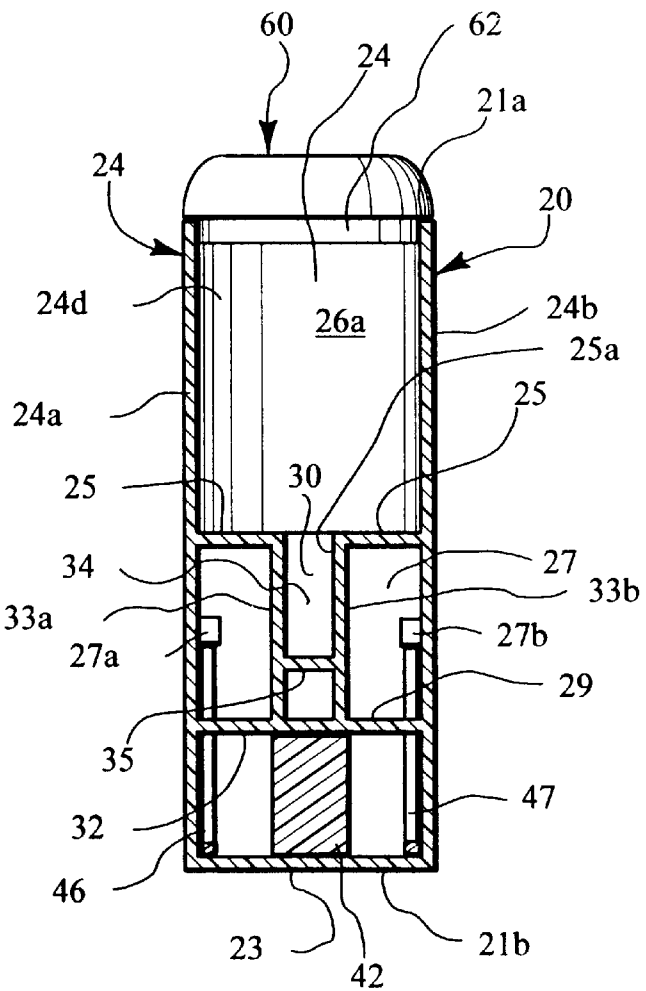
FIG. 6 is a section view of the safety dispenser of FIG. 4 shown assembled along section line 6—6 of FIG. 4, wherein the safety dispenser is shown in a "locked" position.

With additional reference to FIGS. 3 and 6, a vertical wall 27 is integrally-molded with the dividing wall 26 and depends downwardly therefrom into the cavity lower portion 26*b* a predetermined distance. The vertical wall 27 is further integrally-molded with the side wall lateral portions 24*a*, 24*b* and is disposed with respect thereto towards the second side wall transverse end portion 24*d*.

The first side wall transverse end portion 24*c* extends downwardly from the open upper end 21*a* of the container portion 20 towards the bottom wall 23 and cooperates with the bottom wall 23 and with the side wall lateral portions 24*a*, 24*b* to define the opening 22 in the container portion 20 towards the lower end 21*b* thereof sized to slidingly receive the trigger 40.

A channel wall 28 is integrally-molded with, and connects respective lower ends of, the side wall first transverse end portion 24*c* and the vertical wall 27, thereby defining a cavity lower portion hopper area 30 between the dividing wall 25 and the channel wall 28. The channel wall 28 includes a downwardly-stepped portion 29 defining a channel 32 between the stepped portion 29 and the bottom wall 23. The channel 32 is sized to slidingly receive the trigger 40.

The hopper area 30 communicates with the cavity upper portion 26*a* by a lateral slot 25*a* provided through the dividing wall 25 and is defined on opposing lateral sides by first and second wall portions 33*a*, 33*b*, respectively, integrally-molded with and connecting the dividing wall 25, the channel wall 28 and the channel wall stepped portion 29 along side peripheral edges of the lateral slot 25*a*. The hopper area 30 is further defined on a forward transverse end by the side wall first transverse end portion 24*c* and on a rearward transverse end by a sloped wall 34 integrally-molded with and connecting the dividing wall 25 and the channel wall stepped portion 29 along a rearward end peripheral edge of the lateral slot 25*a*.

A guide wall 35 is integrally-molded with the channel wall 28 and with the first and second wall portions 33*a*, 33*b* and includes a sloped portion 35*a* opposing the sloped wall 34 spaced forwardly therefrom a predetermined distance. A hole 36 is provided through the channel wall stepped portion 29 between the sloped wall 34 and the guide wall sloped portion 35*a*. The lateral slot 25*a*, the hopper area 30 and the hole 36 are each sized to permit a pill, tablet, capsule or the like, to travel from the cavity upper portion 26, through the dividing wall slot 25*a*, through the hopper area 30 and into the channel 32. The hopper first and second wall portions 33*a*, 33*b* are sized to orient the pills from a random, oblique orientation, such as, for example, as the pills are typically disposed within the cavity upper portion 26*a*, into a substantially upright, planar orientation. The guide wall sloped portion 35*a* and the sloped wall 34 are sized to further orient the pills from a substantially planar orientation, such as, for example, as the pills are typically disposed within the hopper area 30, into a substantially end-to-end orientation suitable for one-at-a-time passing of the pills through the hole 36 and into the channel 32.

With reference back to FIG. 1, the trigger 40 is of an integrally-molded construction and includes a body 44 having an upwardly-extending thumb portion 45 near a forward end thereof, a projection 42 extending rearwardly from a rearward end thereof, and a pair of spring members 46, 47 projecting upwardly and rearwardly therefrom spaced on either side of the projection 42 a predetermined distance. A tab 43 extends rearwardly from a rearward end of the projection 42. Each of the spring members 46, 47 ends in a substantially upwardly-extending end 46*a*, 47*a*. A first stop 48*a* projects upwardly from an upper end of the thumb portion 45 and a second stop 48*b* depends downwardly from a lower end of the thumb portion 45.

Figure 4:
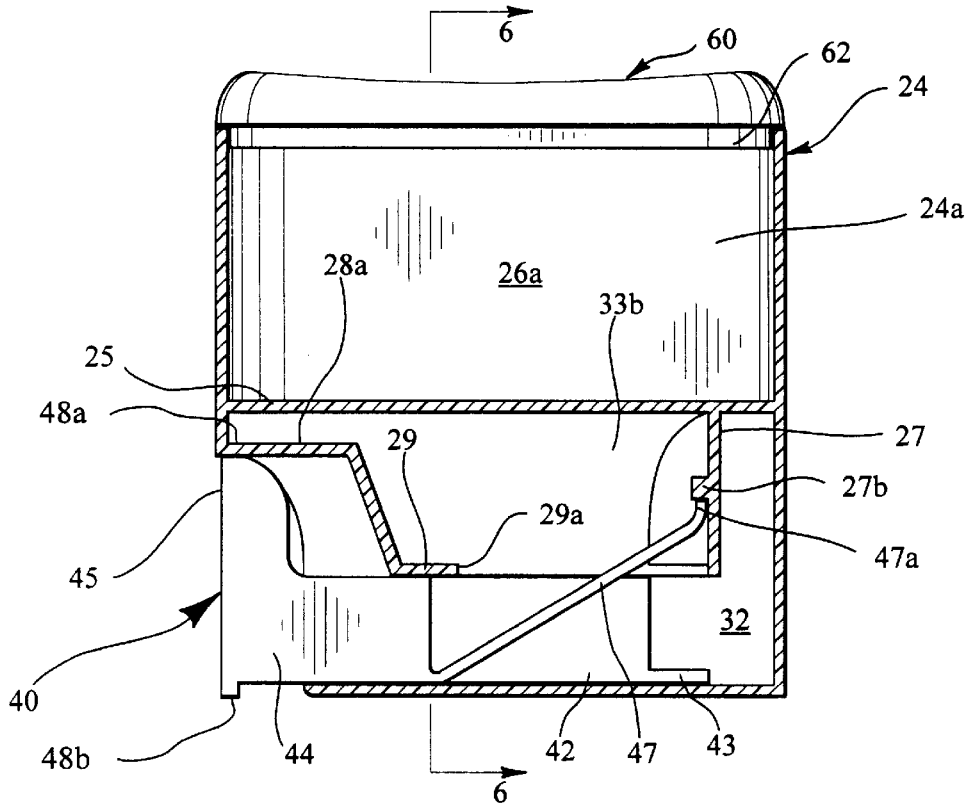
FIG. 4 is a section view of the safety dispenser of FIG. 2 shown assembled along section line 2—2 of FIG. 1, wherein the safety dispenser is shown in an "untriggered" position.
Figure 5:
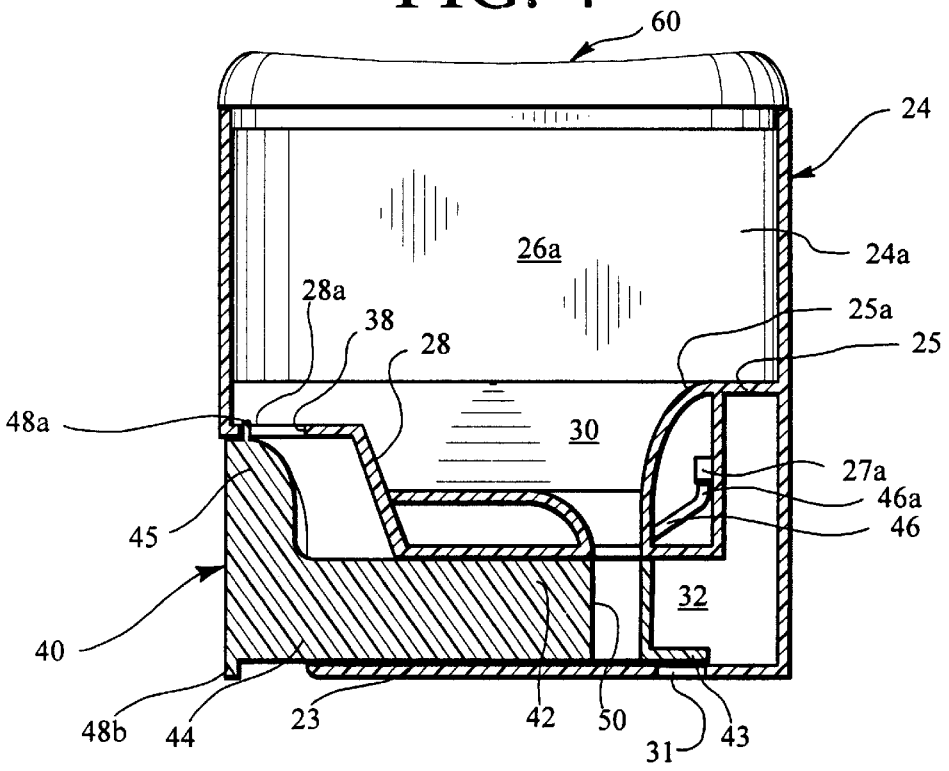
FIG. 5 is a section view of the safety dispenser of FIG. 4 shown along section line 3—3 of FIG. 1.

With additional reference to FIGS. 4–6, the trigger 40 is slidingly received within the channel 32 of the container portion 20. The first stop 48*a* is sized to be slidingly received within a slot 38 provided through an upper portion 28*a* of the channel wall 28 and cooperates with the slot 38 to prevent the trigger 40 from sliding out of the channel 32 and becoming disassociated from the container portion 20. The spring members 46, 47 staddle the hopper area 30 and are spaced transversely outwardly on either side of the hopper wall portions 33*a*, 33*b*, respectively, towards their respective side wall lateral portions 24*a*, 24*b*. A pair of slots 29*a* (only one slot 29*a* being shown) are provided through the channel wall stepped portion 29 on either side of the hopper area 30 and permit the spring members 46, 47 to project upwardly from within the channel 32 vertically above the stepped portion 29 of the channel wall 28 such that the spring member ends 46*a*, 47*a* are seated on respective underside surfaces of a pair of abutments 27*a*, 27*b* integrally-molded with and projecting forwardly from the vertical wall 27. The spring member ends 46*a*, 47*a* and the abutments 27*a*, 27*b* cooperate to prevent the trigger 40 from traveling further rearwardly within the channel 32.

A vertical drop passageway 50 is provided through the projection 42 of the trigger 40 near the rearward end thereof and is sized to permit a pill, tablet, capsule or the like, to pass freely therethrough. More particularly, the passageway 50 is located on the projection 42 such that, when the trigger 40 is in a "locked" position relative to the container portion 20, for example, as shown in FIGS. 4 and 5, the passageway 50 is aligned with the channel wall stepped portion hole 36. Further, the tab 43 extends rearwardly from the rearward end of the projection 42 a sufficient distance to cover a dispensing orifice 31 provided through the bottom wall 23 near the side wall second transverse end portion 24*d* when the trigger 40 is in the "locked" position.

Figure 7:
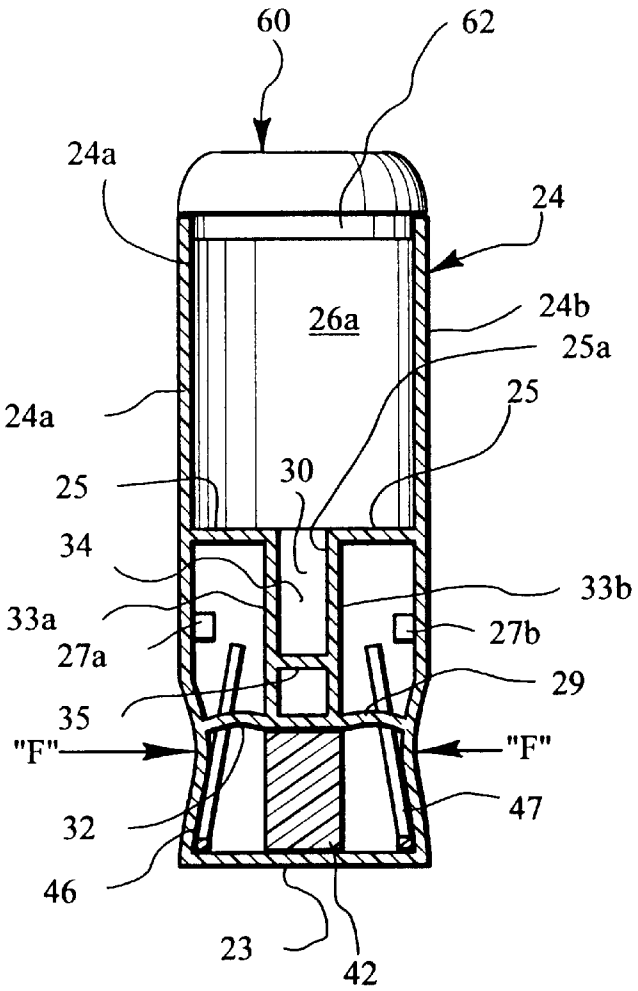
FIG. 7 is a section view of the safety dispenser of FIG. 4 shown assembled along section line 6—6 of FIG. 4, wherein the safety dispenser is shown in an "unlocked" position.
Figure 8:
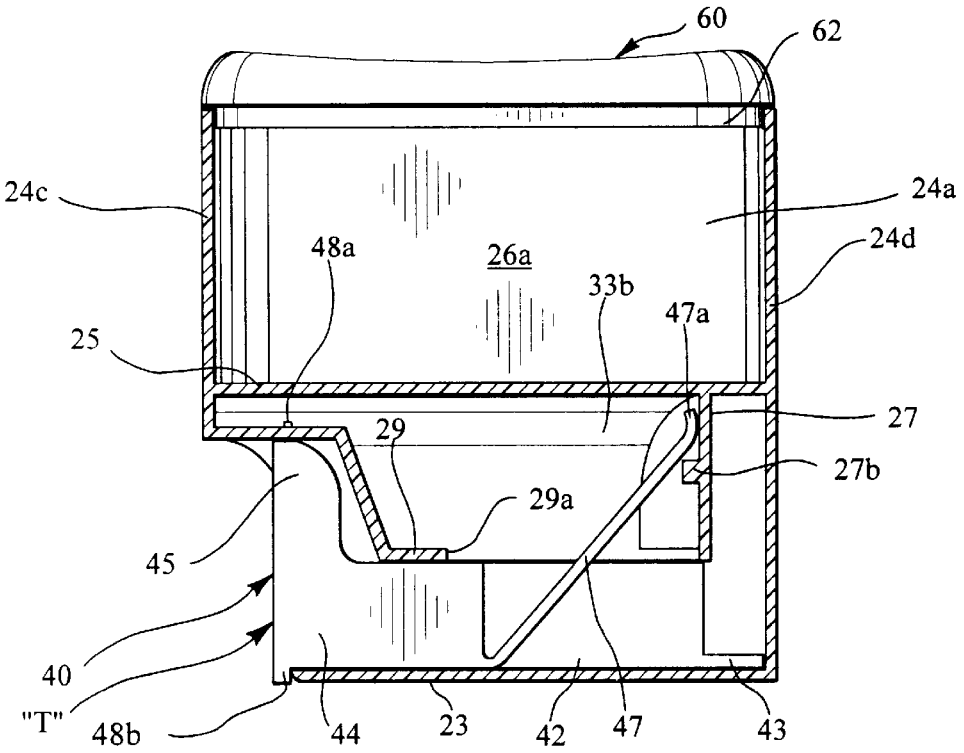
FIG. 8 is a section view of the safety dispenser of FIG. 2 shown assembled along section line 2—2 of FIG. 1, wherein the safety dispenser is shown in a "triggered" position.
Figure 9:
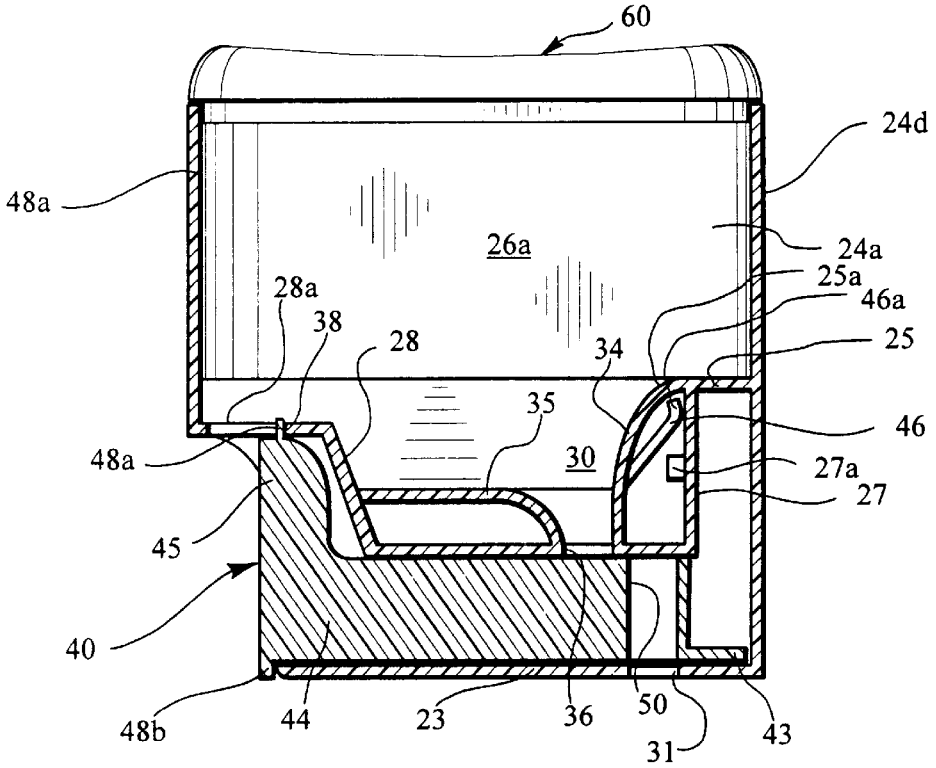
FIG. 9 is a section view of the safety dispenser of FIG. 4 shown assembled along section line 3—3 of FIG. 1, wherein the safety dispenser is shown in a "triggered" position.

With reference to FIGS. 7–9, the trigger 40 is oriented into an "unlocked" position, for example, as shown in FIG. 7, by applying inwardly-directed transverse forces, such as those generally indicated in the Figures by reference letter "F", to the side wall lateral portions 24*a*, 24*b* near the container portion lower end 21*b* outwardlyt adjacent the spring members 46, 47. The spring members 46, 47 are thereby deflected inwardly towards the hopper area 30 a sufficient distance to overcome the abutments 27*a*, 27*b*. A force "T" is then applied to the thumb portion 45, thereby sliding the trigger 40 further within the channel 32. The spring members 46, 47, having been deflected out of the way of the abutments 27*a*, 27*b*, are no longer obstructed thereby and slide upwardly along the vertical wall 27, thereby bending the spring members 46, 47 upwardly with respect to the trigger 40. The second stop 48*b* limits the rearward travel of the trigger 40 within the channel 32 by abutting a forward end of bottom wall 23 and preventing further travel.

Releasing force "T" from the thumb portion 45 causes the resilience in the spring members 46, 47 to push the trigger 40 forwardly in the channel 32 until the first stop 48*a* again abuts an forwardmost end of the slot 38. Further releasing forces "F" from the side wall lateral portions 24*a*, 24*b* permits the resilient spring members 46, 47 to return to their respective "locked" positions under the abutments 27*a*, 27*b*.

The dispensing hole 31 is located in the bottom wall 23 a sufficient distance from the side wall second transverse end portion 24*d* such that the passageway 50 is aligned therewith when the trigger 40 is moved into a "triggered" position, for example, as shown in FIGS. 8 and 9. The trigger projection 42 covers an underside surface of the hole 36 in the "triggered" position, thereby preventing additional pills from falling into the channel 32 during dispensing.

With reference back to FIGS. 1 and 2, the lid 60 is snap-fit onto the open upper end 21*a* of the container portion 20, thereby sealing pills, tablets, capsules or the like therein. Notches, rib, grooves (not shown) or other similar locking features may be provided on either or both a portion of the lid 60 or a portion of the side wall 24 to secure the lid 60 thereto. Alternatively, the lid 60 may include a downward lip 62 which frictionally engages an inner peripheral surface of the side wall 24 at the open upper end 21*a* thereof.

In operation of the safety dispenser 10 according to this embodiment, a plurality of pills, tablets, capsules or the like, are deposited within the cavity upper portion 26*a* and the lid 60 is secured to the upper end 21*a* of the container portion 20. Gravity, or another external force, such as, for example, an individual's shaking the safety dispenser 10, will cause the pills to pass downwardly through the lateral slot 25*a* and into the hopper area 30, where the pills will be in random, but substantially planar, contact with one another. A lowermost pill will assume a substantially upright orientation by the wall portions 33*a*, 33*b*, the guide wall sloped portion 35*a* and the sloped wall 34, and will fall into the passageway 50 of the trigger 40. Transverse forces "F" as hereinabove described are applied to unseat the spring members 46, 47 from underneath the abutments 27*a*, 27*b*, respectively. A force "T" is then applied to the thumb portion 45 to move the trigger 40 (and the pill held within the passageway 50 thereof) laterally over the dispensing orifice 31, at which point, the pill held therein will fall freely therefrom, through the dispensing orifice 31 and out of the safety dispenser 10. Releasing the forces "F", "T" will return the trigger to the "locked" and "untriggered" position, at which point, a second pill will fall from within the hopper area 30 into the passageway 50 for future dispensing.

Figure 10:
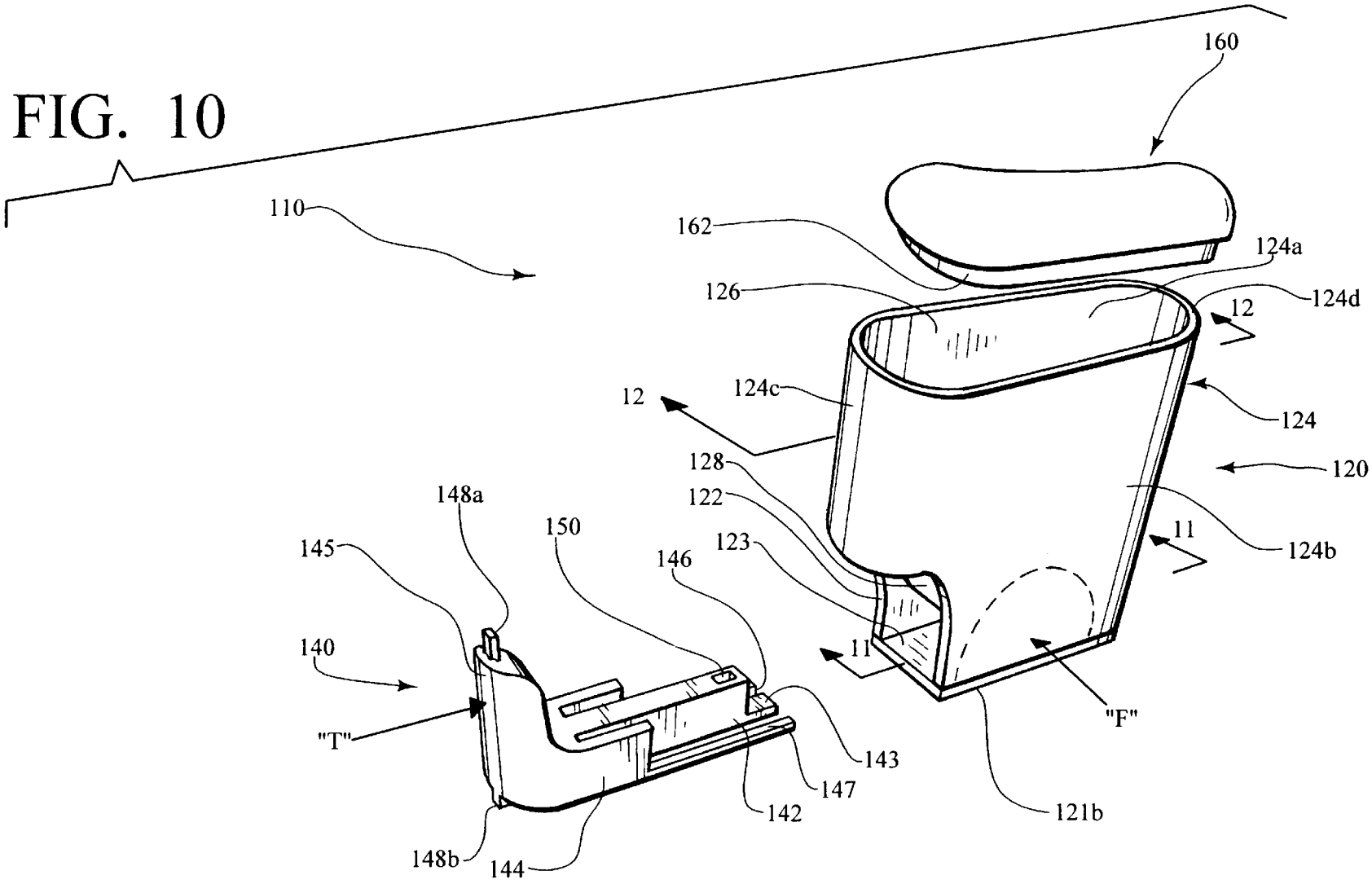
FIG. 10 is an exploded perspective view of an unassembled safety dispenser according to an alternative embodiment of the present invention.

With reference to FIG. 10, a safety dispenser 110 according to one alternative embodiment of the present invention includes a container portion 120, a trigger 140 slidingly received by an opening 122 in the container portion 120 and a lid 160 snap-fit onto an open upper end 121*a* (FIG. 11) of the container portion 120. The container portion 120, the trigger 140 and the lid 160 are each constructed preferably from an integrally-molded plastic, such as, for example, polyethylene or polypropylene, although any suitable material may be substituted in place thereof without departing from either the spirit or the scope of the present invention.

Figure 11:
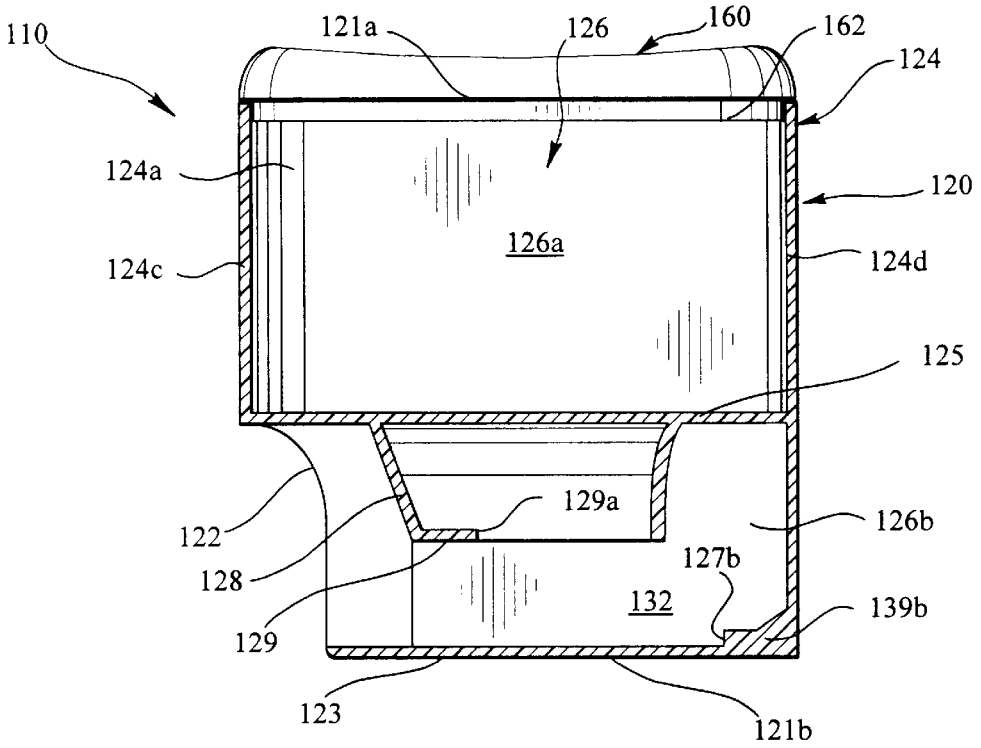
FIG. 11 is a section view of one component of the safety dispenser of FIG. 10 shown along section line 11—11 of FIG. 10.

With additional reference to FIG. 11, the container portion 120 includes a peripheral side wall 124 having first and second opposed lateral portions 124*a*, 124*b* and first and second opposed transverse end portions 124*c*, 124*d*, wherein the side wall 124 defines a cavity 126 for receiving and storing therein a plurality of pills, tablets, capsules or the like, through the open upper end 121*a*. A dividing wall 125 is integrally molded with the side wall 124 and extends across the cavity 126 coextensively between the side wall lateral portions 124*a*, 124*b* and between the side wall transverse end portions 124*c*, 124*d*. The dividing wall 125 defines a cavity upper portion 126*a* between the dividing wall 125 and the open upper end 121*a* of the container portion 120, and a cavity lower portion 126*b* between the dividing wall 125 and a bottom wall 123 provided at a lower end 121*b* of the container portion 120.

Figure 12:
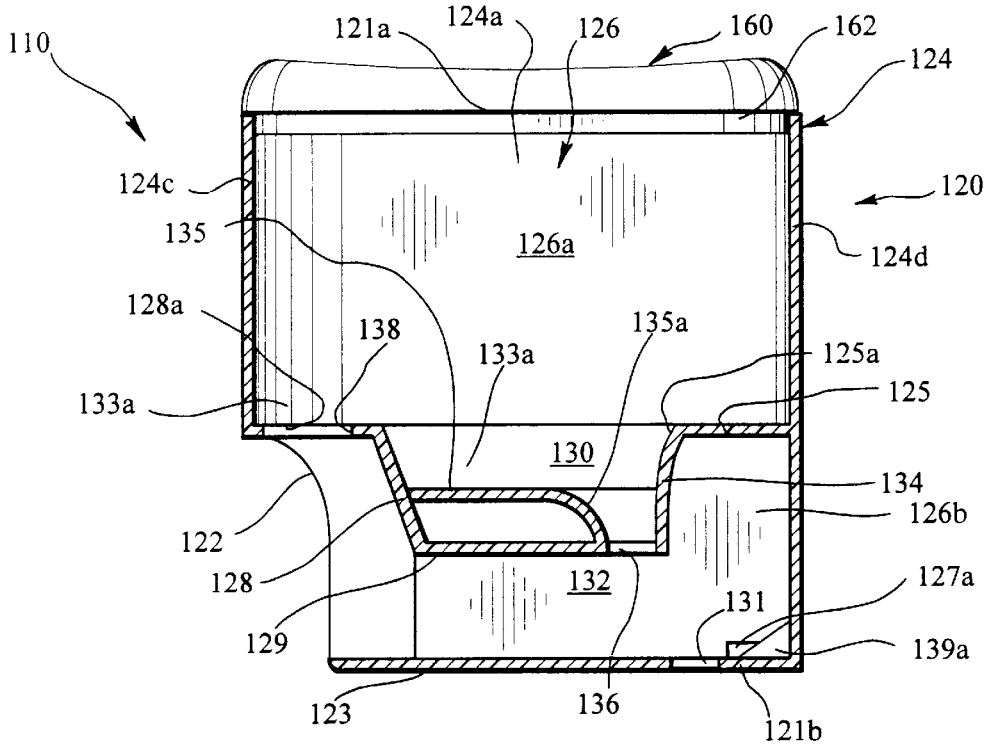
FIG. 12 is a section view of the component of the safety dispenser of FIG. 11 shown along section line 12—12 of FIG. 10.
Figure 15:
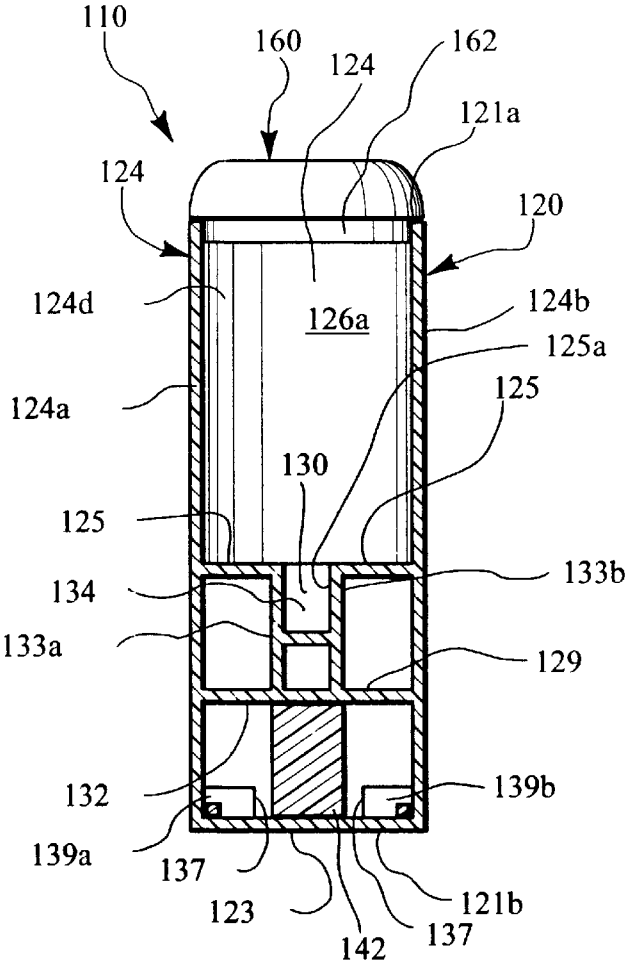
FIG. 15 is a section view of the safety dispenser of FIG. 13 shown assembled along section line 15—15 of FIG. 13, wherein the safety dispenser is shown in a "locked" position.

With additional reference to FIGS. 12 and 15, the first side wall transverse end portion 124*c* extends downwardly from the open upper end 121*a* of the container portion 120 towards the bottom wall 123 and cooperates with the bottom wall 123 and with the side wall lateral portions 124*a*, 124*b* to define the opening 122 in the container portion 120 towards the lower end 121*b* thereof sized to slidingly receive the trigger 140.

A channel wall 128 is integrally-molded with, and connects respective lower ends of, the side wall first transverse end portion 124*c* and a sloped wall 134 depending downwardly from the dividing wall 125, thereby defining a cavity lower portion hopper area 130 between the dividing wall 125 and the channel wall 128. The channel wall 128 includes a downwardly-stepped portion 129 defining a channel 132 between the stepped portion 129 and the bottom wall 123. The channel 132 is sized to slidingly receive the trigger 140.

The hopper area 130 communicates with the cavity upper portion 126*a* by a lateral slot 125*a* provided through the dividing wall 125 and is defined on opposing lateral sides by first and second wall portions 133*a*, 133*b*, respectively, integrally-molded with and connecting the dividing wall 125, the channel wall 128 and the channel wall stepped portion 129 along side peripheral edges of the lateral slot 25*a*. The hopper area 130 is further defined on opposing transverse sides by the side wall first transverse end portion 124*c* and the sloped wall 134, respectively.

A guide wall 135 is integrally-molded with the channel wall 128 and with the first and second wall portions 133*a*, 133*b* and includes a sloped portion 135*a* opposing the sloped wall 134 spaced forwardly therefrom a predetermined distance. A hole 136 is provided through the channel wall stepped portion 129 between the sloped wall 134 and the guide wall sloped portion 135*a*. The lateral slot 125*a*, the hopper area 130 and the hole 136 are each sized to permit a pill, tablet, capsule or the like, to travel from the cavity upper portion 126, through the dividing wall slot 125*a*, through the hopper area 130 and into the channel 132. The hopper first and second wall portions 133*a*, 133*b* are sized to orient the pills from a random, oblique orientation, such as, for example, as the pills are typically disposed within the cavity upper portion 126*a*, into a substantially upright, planar orientation. The guide wall sloped portion 135*a* and the sloped wall 134 are sized to further orient the pills from a substantially planar orientation, such as, for example, as the pills are typically disposed within the hopper area 130, into a substantially end-to-end orientation suitable for one-at-a-time passing of the pills through the hole 136 and into channel 132.

With reference back to FIG. 10, the trigger 140 is of an integrally-molded construction and includes a body 144 having an upwardly-extending thumb portion 145 near a forward end thereof, a projection 142 extending rearwardly from a rearward end thereof, and a pair of spring members 146, 147 projecting rearwardly therefrom spaced on either side of the projection 142 a predetermined distance. A tab 143 extends rearwardly from a rearward end of the projection 142. A first stop 148*a* projects upwardly from an upper end of the thumb portion 145 and a second stop 148*b* depends downwardly from a lower end of the thumb portion 145.

Figure 13:
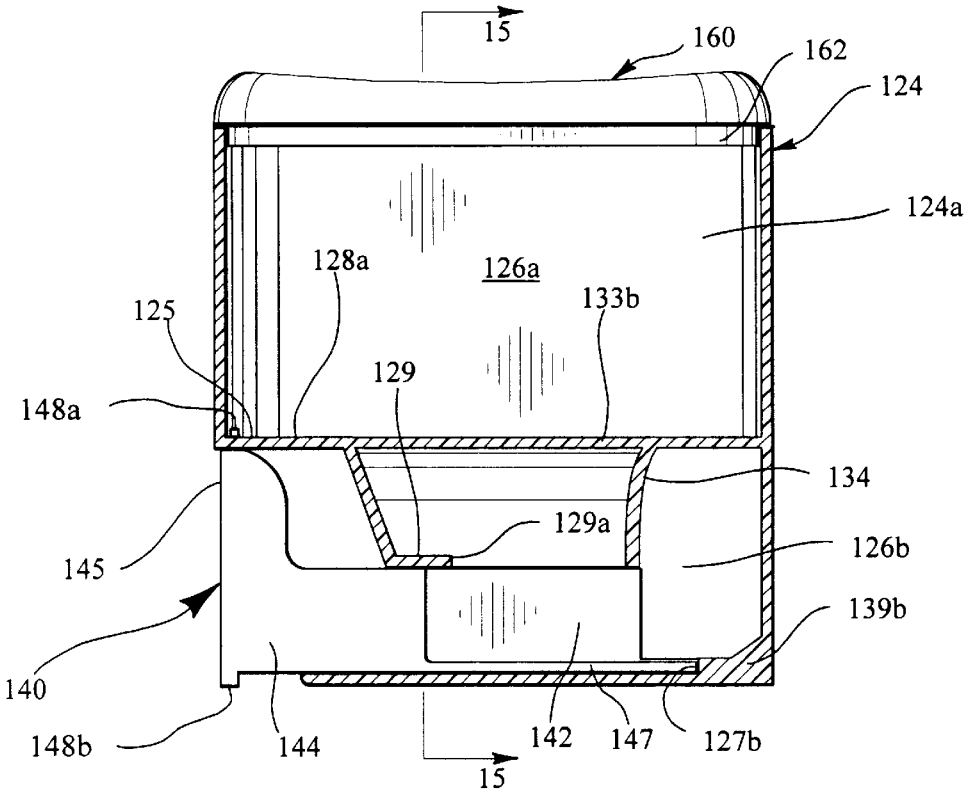
FIG. 13 is a section view of the safety dispenser of FIG. 11 shown assembled along section line 11—11 of FIG. 10, wherein the safety dispenser is shown in an "untriggered" position.
Figure 14:
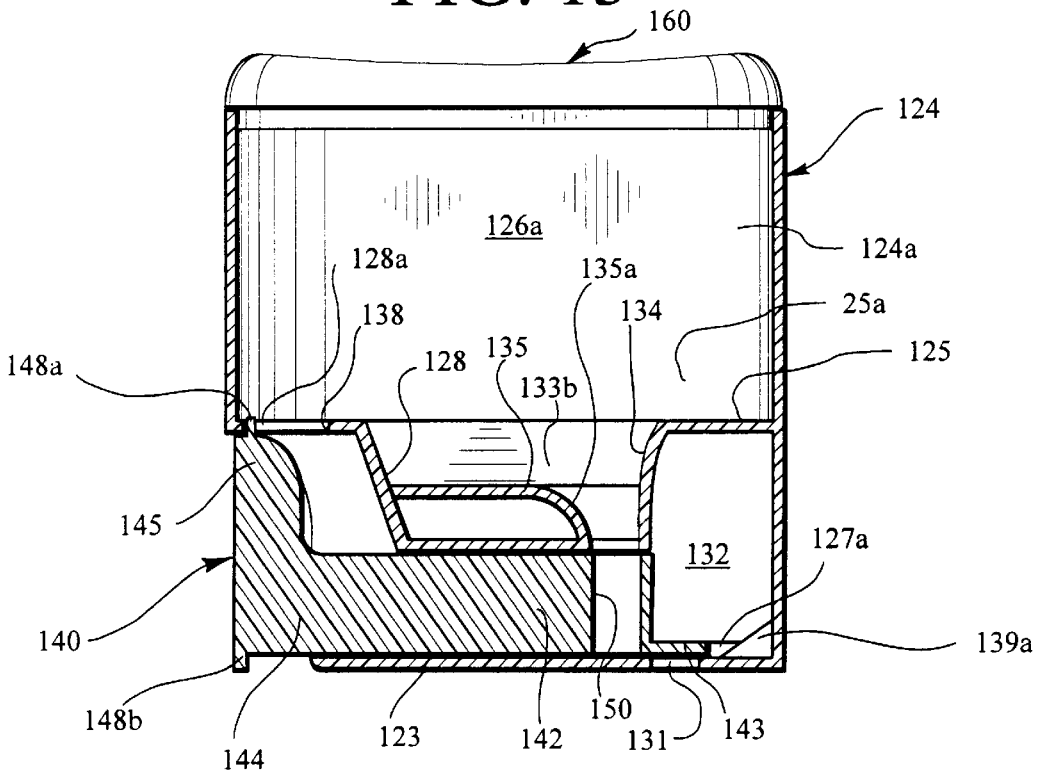
FIG. 14 is a section view of the safety dispenser of FIG. 13 shown along section line 12—12 of FIG. 10.

With additional reference to FIGS. 13–15, the trigger 140 is slidingly received within the channel 132 of the container portion 120. The first stop 148*a* is sized to be slidingly received within a slot 138 provided through an upper portion 128*a* of the channel wall 128 and cooperates with the slot 138 to prevent the trigger 140 from sliding out of the channel 132 and becoming disassociated from the container portion 120.

A first incline 139*a*, is integrally-formed with the side wall 124 and is disposed towards a portion thereof where the second side wall transverse end portion 124*d* intersects with the bottom wall 123 and with the first side wall lateral portion 124*a*. A second incline 139*b*, is integrally-formed with the side wall 124 and is disposed towards a portion thereof where the second side wall transverse end portion 124*d* intersects with the bottom wall 123 and with the second side wall lateral portion 124*b*. The first and second inclines 139*a*, 139*b* are angled upwardly from the lower wall 123, whereat the leading edges of the inclines 139*a*, 139*b* are flush therewith, towards the second side wall transverse end portion 124*d*. A cut-out 137 is provided between the first and second inclines 139*a*, 139*b*, and includes a sufficient width to slidingly receive the tab 143 and the projection 142 therein.

A first abutment 127*a* is integrally-formed with the first side wall lateral portion 124*a* and with the bottom wall 123, near the leading edge of the first incline 139*a*, and projects transversely towards the second side wall lateral portion 124*b* a predetermined distance. A second abutment 127*b* is integrally-formed with the second side wall lateral portion 124*b* and with the bottom wall 123, near the leading edge of the first incline 139*b*, and projects transversely towards the first side wall lateral portion 124*a* a predetermined distance. The spring members 146, 147 and the abutments 127*a*, 127*b* cooperate to prevent the trigger 140 from traveling further rearwardly within the channel 132.

A vertical drop passageway 150 is provided through the projection 142 of the trigger 140 near the rearward end thereof and is sized to permit a pill, tablet, capsule or the like, to pass freely therethrough. More particularly, the passageway 150 is located on the projection 142 such that, when the trigger 140 is in a "locked" position relative to the container portion 120, for example, as shown in FIGS. 13 and 14, the passageway 150 is aligned with the channel wall stepped portion hole 136. Further, the tab 143 extends rearwardly from the rearward end of the projection 142 a sufficient distance to cover a dispensing orifice 131 provided through the bottom wall 123 near the side wall second transverse end portion 124*d* when the trigger 140 is in the "locked" position.

Figure 16:
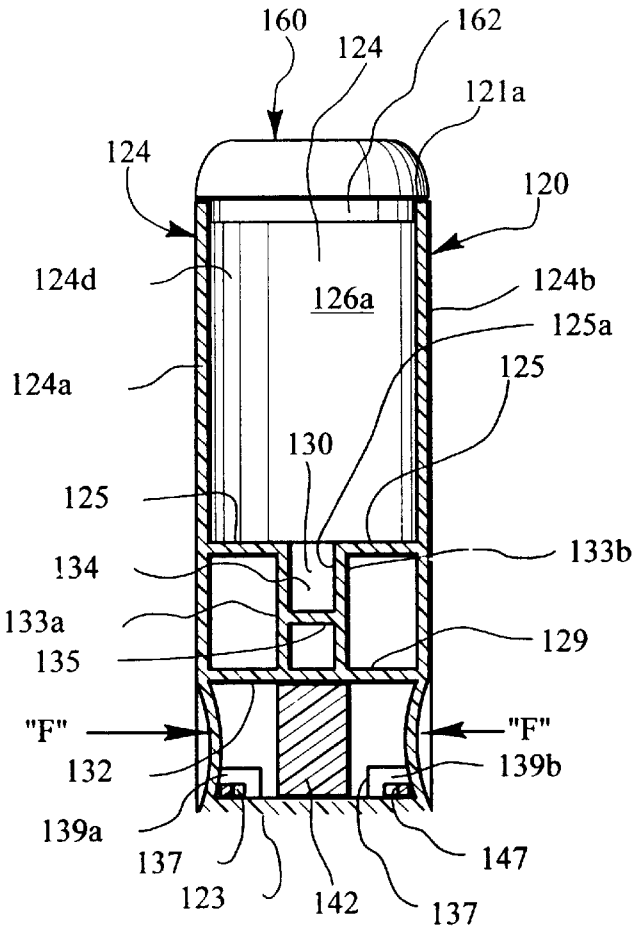
FIG. 16 is a section view of the safety dispenser of FIG. 13 shown assembled along section line 15—15 of FIG. 13, wherein the safety dispenser is shown in an "unlocked" position.
Figure 17:
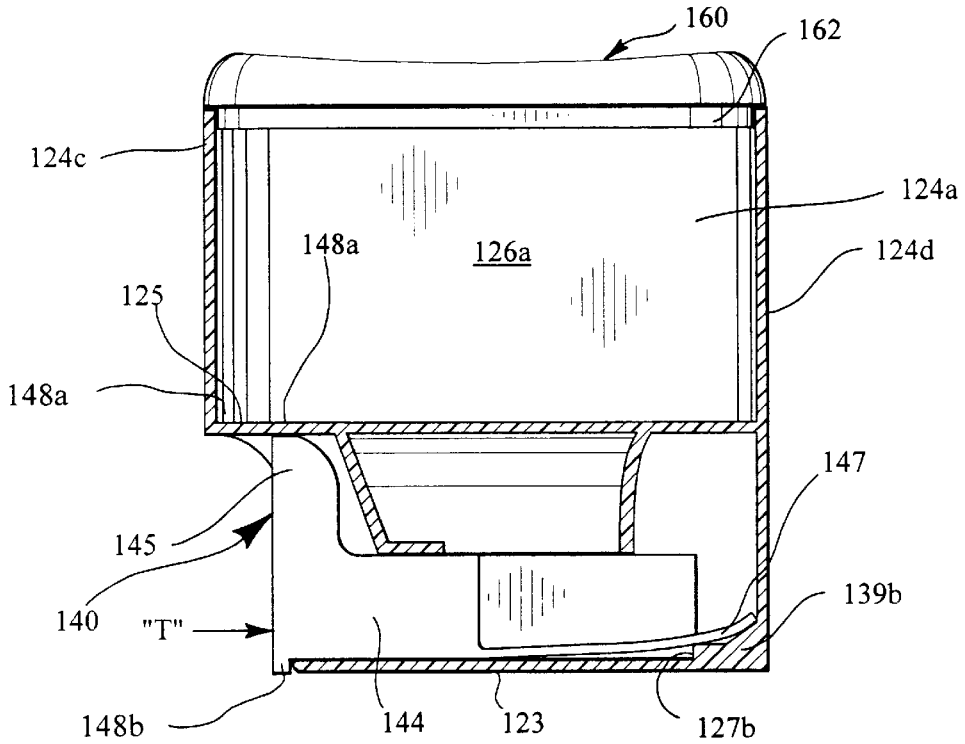
FIG. 17 is a section view of the safety dispenser of FIG. 11 shown assembled along section line 11—11 of FIG. 10, wherein the safety dispenser is shown in a "triggered" position; and, FIG. 18 is a section view of the safety dispenser of FIG. 13 shown assembled along section line 12—12 of FIG. 10, wherein the safety dispenser is shown in a "triggered" position.
Figure 18:
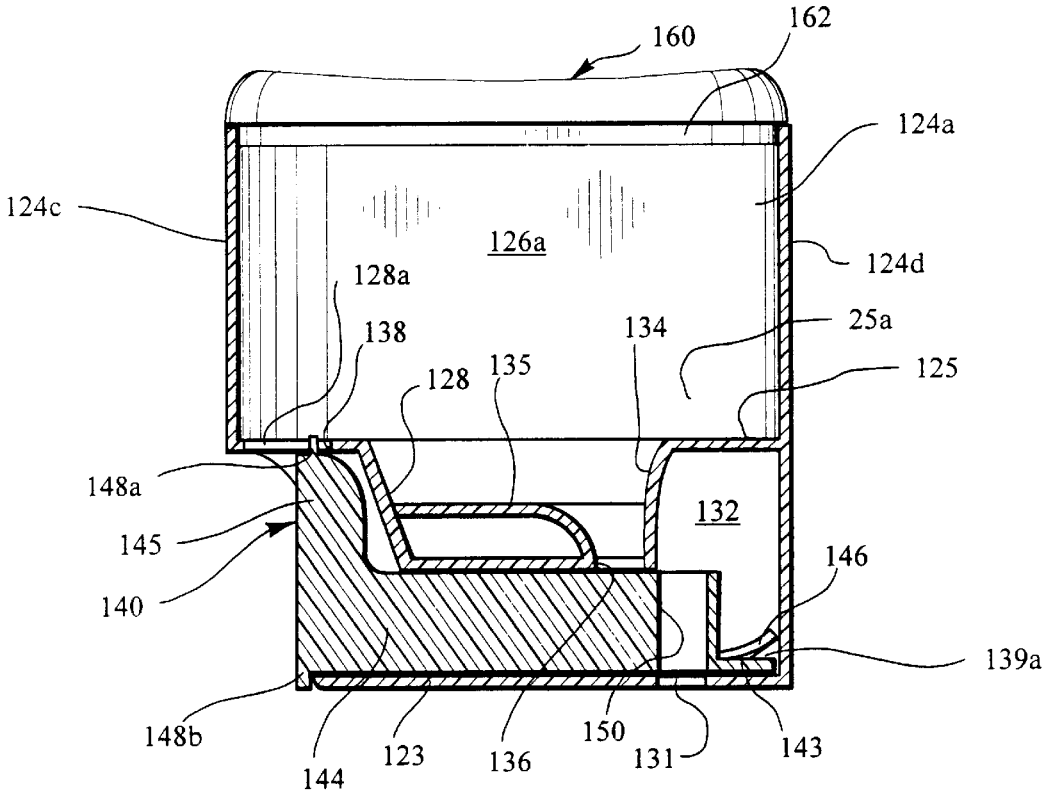

With reference to FIGS. 16–18, the trigger 140 is oriented into an "unlocked" position, for example, as shown in FIG. 16, by applying inwardly-directed transverse forces, such as those generally indicated in the Figures by reference letter "$F_1$", to the side wall lateral portions 124*a*, 124*b* near the container portion lower end 121*b* outwardly adjacent the spring members 146, 147. The spring members 146, 147 are thereby deflected inwardly towards the cut-out 137 a sufficient distance to overcome the abutments 127*a*, 127*b*. A force "$T_1$" is then applied to the thumb portion 145, thereby sliding the trigger 140 further within the channel 132. The spring members 146, 147, having been deflected out of the way of the abutments 127*a*, 127*b*, are no longer obstructed thereby and slide upwardly along the inclines 139, 139*b*, respectively, thereby bending the spring members 146, 147 upwardly with respect to the trigger 140. The second stop 148*b* limits the rearward travel of the trigger 140 within the channel 132 by abutting a forward end of the bottom wall 123 and preventing further travel.

Releasing force "$T_1$" from the thumb portion 145 causes the resilience in the spring members 146, 147 to push the trigger 140 forwardly in the channel 132 until the first stop 148*a* again abuts an forwardmost end of the slot 138. Further releasing forces "$F_1$" from the side wall lateral portions 124*a*, 124*b* permits the resilient spring members 146, 147 to return to their respective "locked" positions forward of the abutments 127*a*, 127*b*.

The dispensing hole 131 is located in the bottom wall 123 a sufficient distance from the side wall second transverse end portion 124*d* such that the passageway 150 is aligned therewith when the trigger 140 is moved into a "triggered" position, for example, as shown in FIGS. 17 and 18. The trigger projection 142 covers an underside surface of the hole 136 in the "triggered" position, thereby preventing additional pills from falling into the channel 132 during dispensing.

Operation of the safety dispenser 110 according to the present embodiment of the present invention is as follows. A plurality of pills, tablets, capsules or the like, are deposited within the cavity upper portion 126*a* and the lid 160 is secured to the upper end 121*a* of the container portion 120. Gravity, or another external force, such as, for example, an individual's shaking the safety dispenser 110, will cause the pills to pass downwardly through the lateral slot 125*a* and into the hopper area 130, where the pills will be in random, but substantially planar, contact with one another. A lowermost pill will assume a substantially upright orientation by the wall portions 133*a*, 133*b*, the guide wall sloped portion 135*a* and the sloped wall 134, and will fall into the passageway 150 of the trigger 140. Transverse forces "$F_1$" as hereinabove described are applied to unseat the spring members 146, 147 from behind the abutments 127*a*, 127*b*, respectively. A force "$T_1$" is then applied to the thumb portion 145 to move the trigger 140 (and the pill held within the passageway 150 thereof) laterally over the dispensing orifice 131, at which point, the pill held therein will fall freely therefrom, through the dispensing orifice 131 and out of the safety dispenser 110. Releasing the forces "$F_1$", "$T_1$" will return the trigger to the "locked" and "untriggered" position, at which point, a second pill will fall from within the hopper area 130 into the passageway 150 for future dispensing.

Although the present invention has been described in terms of specific embodiments which are set forth in detail, it should be understood that this is by illustration only and that the present invention is not necessarily limited thereto, since alternative embodiments not described in detail herein will become apparent to those skilled in the art in view of the disclosure. Accordingly, modifications are contemplated which can be made without departing from either the spirit or the scope of the present invention as described hereinabove.

I claim:

1. A safety dispenser, comprising:

a container portion having a resilient peripheral side wall defining a cavity therein, an open upper end, a bottom wall and a channel wall disposed between said upper end and said bottom wall, said channel wall extending across said cavity and defining a hopper area and a channel thereby;

a trigger being slidingly received by said channel, said trigger having a passageway therethrough and at least one spring member projecting therefrom;

said trigger being moveable within said channel between a first position and a second position, said passageway being in communication with a hole in said channel wall when said trigger is in said first position, said passageway being in communication with an orifice in said bottom wall when said trigger is in said second position;

said at least one spring member being engageable with at least one abutment integrally-formed with said container portion, said at least one spring member being disengagable from said at least one abutment upon applying a force to said peripheral side wall;

said at least one spring member biasing said trigger in said first position; and at least one incline extending upwardly from said bottom wall to said side wall, said at least one spring member being slideable upwardly along said at least one incline as said trigger moves from said first position to said second position.

2. The safety dispenser of claim 1, further comprising:

a dividing wall extending across said cavity between said open upper end and said channel wall, said dividing wall defining a cavity upper portion between said dividing wall and said container portion open upper end, said hopper area being in communication with said cavity upper portion through a slot provided in said dividing wall.

3. The safety dispenser of claim 1, wherein:

said trigger includes a tab projecting therefrom, said tab covering said orifice when said trigger is in said first position.

4. The safety dispenser of claim 1, wherein:

said trigger includes a first tab projecting upwardly therefrom, said first tab being slidingly received by a first tab-receiving slot in said channel wall.

5. The safety dispenser of claim 1, wherein:

said trigger includes a stop tab depending downwardly therefrom.

6. The safety dispenser of claim 1, further comprising:

a lid being received by said open upper end of said container portion.

7. The safety dispenser of claim 1, wherein:

said at least one abutment is disposed on a vertical wall depending upwardly from said channel wall, said channel wall having at least one slot therein to permit said at least one spring member to pass upwardly therethrough, said at least one spring member being slidable along said vertical wall as said trigger moves from said first position to said second position.

8. The safety dispenser of claim 1, wherein:

said at least one abutment is disposed on said bottom wall near said at least one incline.

* * * * *